US007048307B1

(12) United States Patent
Scarbrough et al.

(10) Patent No.: US 7,048,307 B1
(45) Date of Patent: May 23, 2006

(54) REFLECTIVE DISPLAY

(75) Inventors: Joel Scott Scarbrough, Burlington, WI (US); Daniel C. Faul, West Bend, WI (US)

(73) Assignee: Serigraph, Inc., West Bend, WI (US)

( * ) Notice: Subject to any disclaimer, the term of this patent is extended or adjusted under 35 U.S.C. 154(b) by 185 days.

(21) Appl. No.: 10/388,782

(22) Filed: Mar. 14, 2003

(51) Int. Cl.
*B42D 15/00* (2006.01)

(52) U.S. Cl. ..... 283/41; 283/91; 283/107; 283/109; 428/40.1; 428/41.7; 428/42.1; 428/42.3; 428/195

(58) Field of Classification Search ..... 283/41, 283/91, 107, 109; 428/40.1, 195, 41.7, 42.1, 428/42.3
See application file for complete search history.

(56) References Cited

U.S. PATENT DOCUMENTS

| | | | | | |
|---|---|---|---|---|---|
| 4,269,916 | A * | 5/1981 | Bilofsky et al. | 430/11 |
| 4,913,504 | A | 4/1990 | Gallagher | 350/3.6 |
| 4,933,218 | A | 6/1990 | Longobardi | 428/38 |
| 5,082,703 | A | 1/1992 | Longobardi | 428/38 |
| 5,106,126 | A | 4/1992 | Longobardi et al. | 283/94 |
| 5,270,101 | A | 12/1993 | Helicher | 428/209 |
| 5,328,738 | A * | 7/1994 | McKillip et al. | 428/40.9 |
| 5,411,296 | A * | 5/1995 | Mallik | 283/86 |
| 5,456,967 | A | 10/1995 | Nezu | 428/141 |
| 5,492,370 | A | 2/1996 | Chatwin et al. | 283/110 |
| 5,582,103 | A * | 12/1996 | Tanaka et al. | 101/32 |
| 5,688,738 | A * | 11/1997 | Lu | 503/227 |
| 5,714,213 | A * | 2/1998 | Antes et al. | 428/30 |
| 5,741,578 | A | 4/1998 | Sax | 428/212 |
| 5,742,411 | A | 4/1998 | Walters | 359/2 |
| 5,744,219 | A | 4/1998 | Tahara | 428/195 |
| 5,762,379 | A | 6/1998 | Salmon et al. | 283/91 |
| 5,851,032 | A | 12/1998 | Green | 283/72 |
| 6,042,888 | A | 3/2000 | Sismanis et al. | 427/256 |
| 6,113,149 | A | 9/2000 | Dukatz | 283/91 |
| 6,132,822 | A | 10/2000 | Overcash et al. | 428/34.2 |
| 6,145,565 | A | 11/2000 | Fromson et al. | 156/580 |
| 6,170,881 | B1 | 1/2001 | Salmon et al. | 283/91 |
| 6,180,228 | B1 | 1/2001 | Mueller et al. | 428/354 |
| 6,181,446 | B1 | 1/2001 | Cox et al. | 359/3 |
| 6,187,389 | B1 | 2/2001 | Overcash et al. | 427/488 |
| 6,358,588 | B1 * | 3/2002 | Edwards et al. | 428/42.2 |
| 6,788,451 | B1 * | 9/2004 | Mortarotti | 359/296 |
| 6,856,462 | B1 * | 2/2005 | Scarbrough et al. | 359/619 |
| 2003/0184862 | A1 * | 10/2003 | Sahouani et al. | 359/490 |
| 2003/0205895 | A1 * | 11/2003 | Scarbrough et al. | 283/91 |
| 2004/0076788 | A1 * | 4/2004 | Steinhardt et al. | 428/57 |
| 2004/0140665 | A1 * | 7/2004 | Scarbrough et al. | 283/95 |
| 2005/0210694 | A1 * | 9/2005 | Leyden et al. | 33/492 |

FOREIGN PATENT DOCUMENTS

| | | | |
|---|---|---|---|
| EP | 0159828 | A1 * | 10/1985 |
| WO | WO 98/33660 | | 8/1998 |
| WO | WO 02/076721 | A1 * | 10/2002 |

* cited by examiner

*Primary Examiner*—Boyer D. Ashley
*Assistant Examiner*—Mark Henderson
(74) *Attorney, Agent, or Firm*—Andrus, Sceales, Starke & Sawall, LLP

(57) ABSTRACT

A display includes a base having a front surface, an adhesive pattern formed over a first area of the front surface, a reflective layer over the adhesive pattern, and may include an image formed over a second area of the front surface which is at least partially not occupied by the reflective layer. A manufacturing method improves economy of manufacture by combining a texture pattern layer and an adhesive layer.

9 Claims, 4 Drawing Sheets

REFLECTIVE DISPLAY

BACKGROUND AND SUMMARY

The invention relates to reflective displays, including image displays, and methods of manufacture, for example trading cards, greeting cards, signs, posters, labels, decals, book covers, decorative panels, packaging, name plates, and other displays including designs incorporating a selective area of metallic appearance resembling liquid metal, and other reflective displays.

The invention arose during continuing development efforts relating to image displays, including printed articles, including subject matter related to U.S. Pat. Nos. 6,170,881 and 5,762,379 owned by the assignee of the present invention, and incorporated herein by reference.

Highly reflective materials have long been known to attract the human eye. Metallic inks, hot stamping foils, vacuum metallized substrates, metallic flakes incorporated into inks and coatings have all been used to impart such eye catching and aesthetically pleasing effects to decorated articles. Each of these techniques has advantages and disadvantages. The major disadvantage has been the inability to apply a metallic or holographic effect selectively and impart texture and/or thickness if desired to the metallic area. The ability to selectively apply metallics has been limited to printing metallic inks, selectively blocking out a metallic substrate (only allowing the desired areas of the metallic substrate to show through), or to hot stamp. Metallic inks do not have the reflective brilliance of vacuum metallized foils and substrates. Hot stamping requires the use of expensive equipment and expensive hot stamping dyes. The above noted incorporated U.S. Pat. No. 6,170,881 provides one solution. The present invention provides a further improvement, including enhanced economy of manufacture.

DETAILED DESCRIPTION OF THE INVENTION

Figure 1:
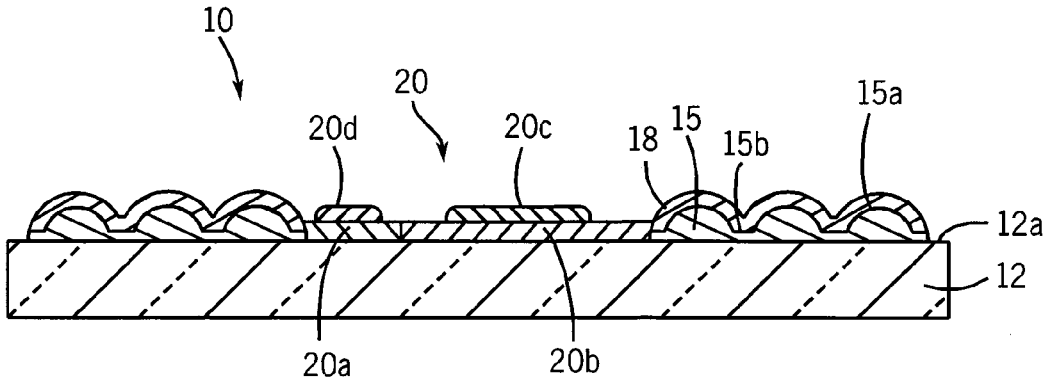
FIG. 1 is a cross-sectional view illustrating a display in accordance with the invention.

As illustrated in FIG. 1, a display is provided by printed article 10 having a visual display formed thereon which is manufactured in accordance with a method of the present invention. The article 10 includes a base sheet 12 which can be opaque or transparent, and flexible or rigid.

An opaque sheet 12 can be formed of paper, cardboard, metal, or any other suitable material. An opaque sheet is appropriate for producing trading cards, greeting cards, signs, posters, labels, book covers, decorative panels, name plates, and the like. Alternatively, the sheet 12 can be replaced by an object having a flat surface, such as the side of a building.

A transparent sheet 12 can be formed of plastic, glass, or any other suitable material. A transparent sheet is appropriate for producing details and the like, and can also be used for producing other items with a rear surface reflective layer and protective cover, in addition to a front surface reflective layer and protective cover, to be described.

An opaque sheet 12 is preferably formed from board or paper stock that is between 8.0 and 30.0 mils thick, although thicker or thinner stock may be used where the application requires. In applications such as trading cards, stock that is approximately 10.0 mils thick is typically used. The board or paper stock should be treated with a moisture stable coating that will prevent ink from being absorbed by the stock.

For applications where greater flexibility is required, such as decals, the base may be relatively thin or composed of a flexible plastic material. Conversely, thicker stock and rigid plastic may be used in applications where rigidity is required, such as free standing displays.

The base sheet 12 has a front surface 12*a* which is typically flat, although the invention is not so limited. An adhesive pattern 15 is formed on surface 12*a*. For those applications where height, depth and dimension is desired, pattern 15 is textured and has a varying thickness with a plurality of thicker portions providing protrusions 15*a* and a plurality of thinner portions providing recesses 15*b*. The protrusions and recesses are in the form of lines, circular bumps, or any other suitable design. The thickness (height) of protrusions 15*a* is approximately 1.0 to 1.5 mils to ensure visibility, and the thickness of recesses 15*b* is approximately 0.2 to 0.5 mils, though the thickness may be made larger or smaller to suite particular applications. The adhesive pattern layer 15 is formed over base 12 using screen printing, offset printing, or any other suitable process, including other types of printing or other methods such as hand painting. An appropriate adhesive is Rage 800 Clear Ink which is commercially available from Nazdar of Chicago, Ill.

A reflective layer 18 is formed on adhesive 15, such that reflective layer 18 is adhered to the pattern thereof. Reflective layer 18 is preferably formed on monochrome (e.g. solid chrome) or holographic roll leaf. The roll leaf foil is typically secured to a carrier, such as a polyester film, with a release layer therebetween. Adhesive pattern 15 is preferably a heat activated adhesive. Pressure (as well as heat, if adhesive 15 is heat activated) is applied to bond the roll leaf to the pattern 15. The carrier is then removed. The roll leaf used to form reflective layer 18 is different from conventional roll leaf in that it does not have an adhesive on its exposed surface. Instead, the adhesive is provided by pattern 15. Although the carrier with the roll leaf thereon is provided as a continuous sheet, the reflective foil layer thereon is transferred from the carrier to the pattern 15 only where the adhesive is present, to form the reflective layer 18. Roll leaf in areas in which the adhesive is not present remains attached to the carrier. A suitable monochrome roll leaf material is MEZ 5900 Chrome, which is commercially available from Astor Universal of Lenexa, Kans., and is applied using any conventional laminating technique which is available in the art for applying roll leaf. A suitable reflective holographic roll leaf is SEZ 5995 Chrome Rainbow Holographic, which is also commercially available from Astor Universal. Gold reflective and holographic roll leaf, as well as other types and colors of roll leaf, are also commercially available and are suitable for practicing the present invention. Although roll leaf is the preferred material for forming the reflective layer 18, the invention is not so limited, and any other suitable material can be used to form the reflective layer 18. In some instances, some of the release coat will remain on the exposed surface of the roll leaf. As such, a primer (not shown) can be applied to the roll leaf to ensure that a subsequently applied ink image will stick to it. The primer may be water-based, UV curable, or conventional, and may be applied by lithography, silk-screening, or flexography. As a result, the surface of the reflective layer 18 follows the surface of pattern 15, and if the latter is textured, the portions of the reflective layer 18 overlying the protrusions 15*a* are raised above the neighboring areas 15*b* of the pattern 15. This produces an embossed effect which simulates a three-dimensional image.

Further illustrated in FIG. 1 are the results of performing a step of forming an ink image 20 on the surface 12*a* in an area not occupied by pattern 15. The image 20 can include opaque ink, at least partially transparent or translucent ink, or any combination thereof. As illustrated, the ink image 20 includes an area 20*a* formed of at least partially transparent or translucent ink, and an area 20*b* formed of opaque ink on the surface 12*a*. Typically, the image 20 will be formed using a conventional four-color printing process, using inks of three primary colors in combination with black ink. Suitable printing processes include lithography, silk-screening, and gravure. The image 20 can further include an area 20*c* of at least partially transparent or translucent ink formed on the opaque area 20*b* and/or an area 20*d* of opaque ink formed on the transparent area 20*a*. The portion of the transparent ink area 20*a* underlying the opaque ink area 20*d* is not visible to the viewer, but may be included to simplify the printing of the entire image 20. The opaque area 20*d* can be white to enhance the simulated depth effect. It is further within the scope of the invention to form transparent ink images on top of other transparent ink images, and opaque images on top of other opaque images, if doing so simplifies the printing process. The opaque ink areas 20*b* and 20*d* present a conventional flat, two-dimensional appearance to the viewer. The transparent area 20*c* may be tinted with a color which is different from the underlying opaque area 20*b*, such that the colors of the areas 20*c* and 20*b* combine to produce a third color.

The base sheet 12 can be opaque, with the surface 12*a* being white or of any other suitable color. Light passing through the portion of the transparent ink area 20*a* which is not covered by the area 20*d* will be reflected back to the viewer, and the color of this portion of the area 20*a* will be a combination of the color of the tinting of the area 20*a* and the color of the surface 12*a*. In this arrangement, the transparent areas of the image 20 produce a different visual effect from the opaque areas of the image 20.

An opaque base sheet 12 can be formed of card stock having a white reflective front surface 12*a*. In this case, a white shiny image area can be provided by the surface 12*a* itself without the necessity of printing the ink image 20 in this area. In an exemplary case of an image having a large white background, substantial economy can be realized by not having to print ink in the background area.

In the arrangement of FIG. 1, it is within the scope of the invention to form pattern 15 and reflective layer 18 first, and then form the ink image 20. Alternatively, the ink image can be formed first, and then the pattern 15 and reflective layer 18.

Figure 2:
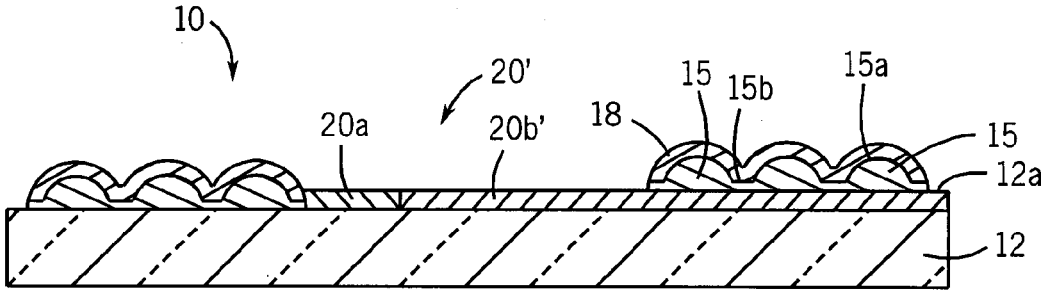
FIG. 2 is like FIG. 1 and shows a further embodiment.

FIG. 2 illustrates a variation of the method of FIG. 1, in which an ink image 20' is formed first, and the pattern 15 and reflective layer 18 are formed subsequently. Like elements are designated by the same reference numerals used in FIG. 1, where corresponding but modified elements are designated by the same reference numerals primed. In this case, the overall processing may be facilitated by forming the ink image 20' over all or part of the surface 12*a*, and then forming the pattern 15 and reflective layer 18 over all or part of the image 20'. As shown, a portion of the opaque layer 20*b*' extends under the right portion of the pattern 15. Thus, pattern 15 is formed in a first area, the ink image 20' is formed in a second area, and the pattern 15 and image 20' overlap in a third area which is co-extensive with the first area.

Figure 3:
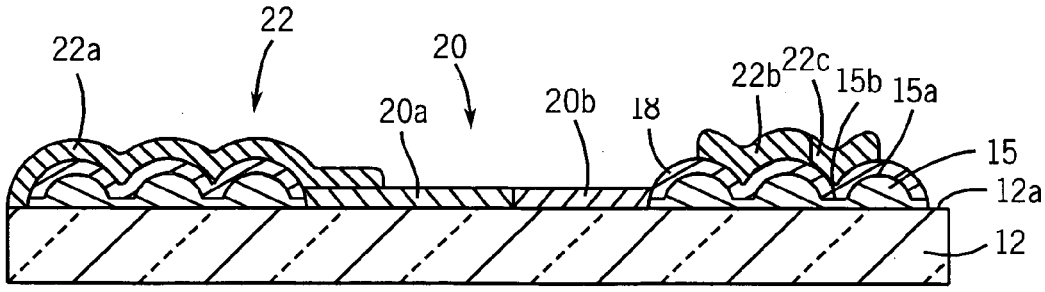
FIG. 3 is like FIG. 1 and shows a further embodiment.

The method of the present invention can further include forming an additional ink image 22 over part or all of the roll leaf foil reflective layer 18 as illustrated in FIG. 3. The image 22 as shown includes a transparent area 22*a* which is formed over the left portion of the reflective layer 18 and the left portion of the ink image 20, a transparent area 22*b* which is formed over part of the right portion of the reflective layer 18, and an opaque area 22*c* which is formed over the right portion of the reflective layer 18. The portion of the reflective layer 18 underlying the opaque area 22*c* will not be visible to a viewer. It is further within the scope of the invention to form the additional image 22 as including multiple layers as illustrated in FIG. 2, and to form transparent ink areas over opaque ink areas.

Figure 4:
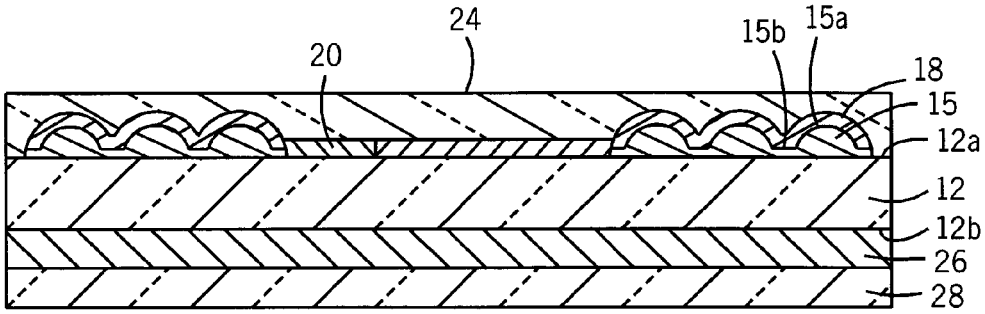
FIG. 4 is like FIG. 1 and shows a further embodiment.

FIG. 4 further illustrates a protective transparent layer 24 which is formed over the reflective layer 18, image 20, and any exposed portions of the surface 12*a*. The layer 24 as illustrated is sufficiently thick that the method can further comprise planarizing the layer 24 in any known manner so that the exposed surface thereof is flat.

Figure 5:
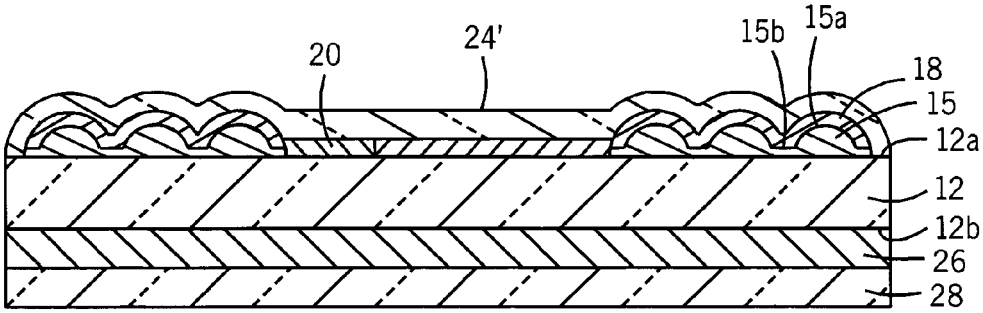
FIG. 5 is like FIG. 1 and shows a further embodiment.

FIG. 5 illustrates an alternative transparent layer 24' which is thinner than the layer 24, and does not have a planar exposed surface. Instead, the exposed surface follows the underlying pattern 15 such that portions of the surface which overlie the protrusions 15*a* (in the case of a textured adhesive pattern 15) are raised to enhance the embossing effect.

The transparent layer 24 or 24' can be formed of any suitable material. Exemplary materials include transparent ink (either water-based, UV curable, or conventional solvent evaporative), catalysts and resin systems which produce a hard finish, and polyester, polyethylene, or polystyrene sheets. Transparent ink and catalyst and resin systems may be applied with a coater, by screen printing, spray painting, or using any other commercially available method, while the polyester sheet may be secured with a clear adhesive. The thickness of transparent layer 24 or 24' may be varied in order to achieve the desired surface texture and appearance. If a relatively thin (approximately 1.0 to 2.0 mils) transparent layer 24 is employed, the top surface of the finished product will have a texture that corresponds to that of the textured pattern 15 as illustrated in FIG. 5. A thicker (approximately 10.0 mils) transparent layer 24 gives the finished product the appearance of depth as illustrated in FIG. 4. If the layer 24 is sufficiently thick, it will not require a subsequent planarization step to produce a flat exposed surface. The thickness of a transparent layer 24 or 24' applied with coaters may be varied by varying the number of coating layers applied. The thickness of a polyester sheet transparent layer will vary with the thickness of the sheet and the clear adhesive (either heat activated or pressure sensitive) which secures the sheet to the pattern 15 and image 20. For example, the adhesive layer (not shown) may be as thin as 1.2 mils and the polyester sheet may be as thin as 0.25 mils, for a combined thickness of approximately 1.5 mils. Thicknesses of approximately 10.0 mils may be achieved with a 2.0 mil sheet and 8.0 mils of adhesive, with a 7.0 mil sheet and 3.0 mils of adhesive, and with all combinations therebetween.

FIGS. 4 and 5 illustrate a layer 26 which is formed on a rear surface 12*b* of the base sheet 12, and a protective transparent layer 28 which is formed over the layer 26. It will be noted that the layers 24, 24', 26, and/or 28 can be applied to the embodiments above or variations thereof. If sheet 12 is transparent, the layer 26 can be an opaque layer of any color or pattern, or a shiny reflective or holographic layer. Where the layer 26 is opaque, it can provide a rear side ink image which is visible by viewing the sheet 12 from the front surface 12*a* or from the rear surface 12*b*, or from both surfaces. The layer 26 is visible through any transparent areas of the image 20. If the layer 26 is opaque, the color of the transparent areas of the image 20 will be a combination of any tinting of the transparent areas and the color of the layer 26. If the layer 26 is reflective, the color of the transparent areas will be the color of the tinting, with a shiny metallic appearance to enhance the simulated depth effect. It is further within the scope of the present invention to omit the reflective layer 26 in one or more areas to produce a clear or color tinted appearance which can be back lit.

A preferred application of a visual display including an opaque base sheet 12 is a trading card, in which case the base sheet 12 will be made of cardboard or other suitable board stock. The front surface 12*a* of the sheet 12 will be white, or be of any other suitable color or pattern of colors. The layer 26 formed on the rear surface 12*b* will be a rear side ink image which is typically formed by printing. A suitable process for forming the rear side ink image is four-color lithography. In this manner, images can be formed on both sides of the sheet 12 without resorting to lamination.

Figure 6:
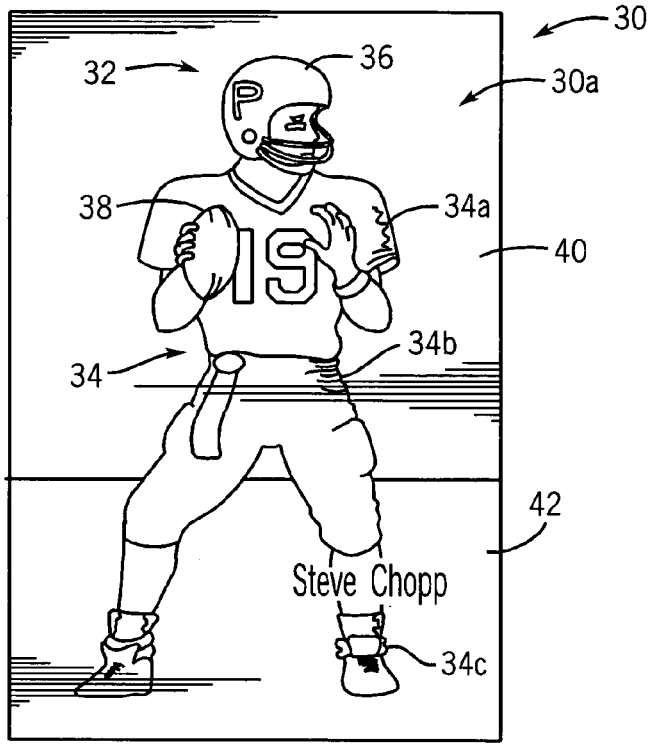
FIG. 6 is a front view of a trading card having an image display in accordance with the invention.
Figure 7:
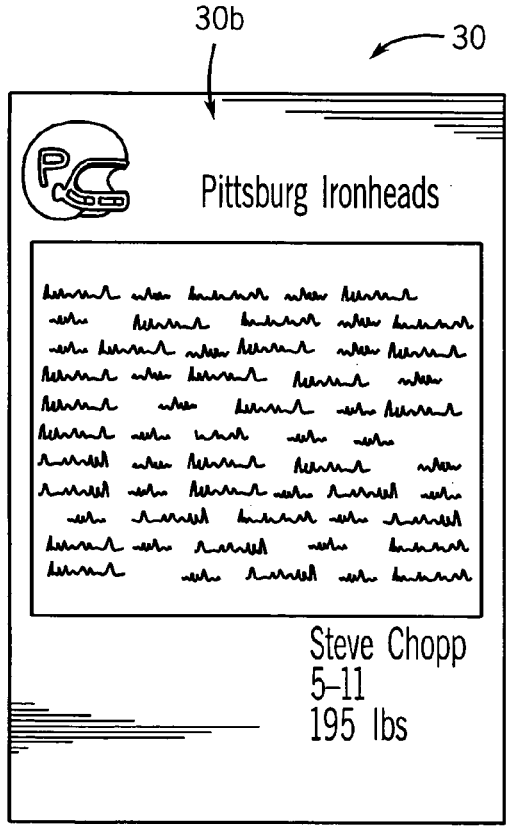
FIG. 7 is a rear view of the trading card of FIG. 6.
Figure 8:
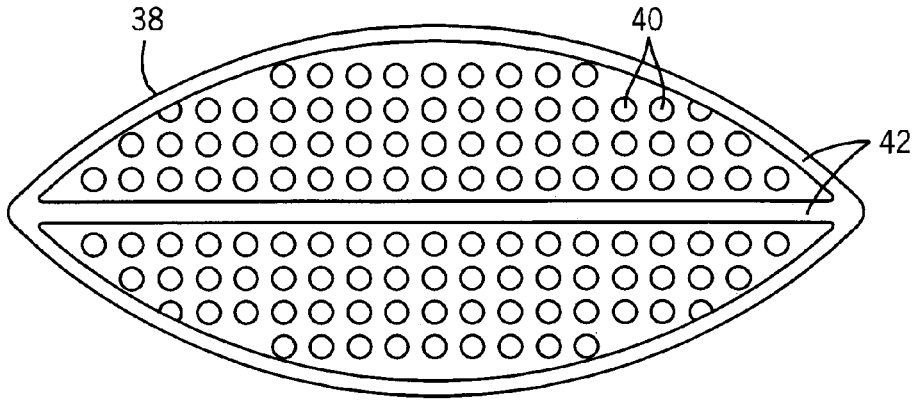
FIG. 8 is an enlarged view of a portion of FIG. 6.

An exemplary football trading card 30 is illustrated in FIGS. 6 to 8. FIG. 6 illustrates a front side 30*a* of the card 30 which has a textured image and an ink image formed thereon in the manner described above with reference to FIG. 1. FIG. 7 illustrates the rear side 30*b* of the card 30 which has an ink image printed thereon as described above with reference to FIGS. 4 and 5. The front side 30*a* of the card 30 includes a picture of a player 32 named Steve Chopp, whereas Steve's biographical data and statistics are printed on the rear side 30*b* of the card 30. As viewed in FIG. 6, the player 32 is wearing a uniform 34 and a helmet 36 and holding a football 38. Further visible is sky 40 and grass 42. The front side 30*a* of the card 30 is formed by printing a textured pattern corresponding to the football 38 and other areas which are to be accentuated by simulated embossing. As illustrated in FIG. 8, the textured pattern of the football 38 typically comprises a plurality of distributed circular protrusions or bumps 40, and continuous protrusions 42 which depict the seams of the football 38. Continuous linear protrusions 15*a* of adhesive pattern 15 are also formed to accentuate items such as portions 34*a* and 34*b* of the uniform 34, and shoelaces 34*c* as viewed in FIG. 6. After the textured pattern including the circular bump protrusions 40 and continuous protrusions 42, 34*a* to 34*c* have been formed on front side 30*a* of the card 30, roll leaf is applied to the textured areas as described above. Then, an ink image is formed on the front side 30*a* of the card 30, except for background and other areas which are to be constituted by the white or other colored surface of the front side 30*a* itself. For example, all areas except for the helmet 36 and football 38 can be formed of opaque ink, whereas transparent or translucent ink will be applied over the helmet 36 and football 38. Thus, the helmet 36 and football 38 will have a shiny appearance to simulate depth, whereas the football 38 and other textured areas will appear embossed to further enhance the simulated depth effect. It is further within the scope of the invention to apply roll leaf to areas of the image which are not textured to provide flat, reflective image areas. Reflective and/or opaque ink can be selectively applied to portions of these areas as described above. A protective transparent layer such as illustrated in FIG. 4 or 5 can be formed on the side 30*a* if desired. The players data is printed on the rear side 30*b* of the card 30 using a conventional lithographic or other suitable process in a separate operation. The rear side 30*b* can be printed before or after forming the front side 30*a*.

The invention provides a method for producing a printed or similarly produced article, which overcomes the drawbacks of the prior art, and enables a pseudo three-dimensional visual display comprising a textured pattern including monochrome or holographic roll leaf to be formed on a surface of a base sheet which can be opaque as well as transparent. The invention enables a two-sided article, such as a trading card, poster, decal, or sign, to be produced by printing an image on the side of the sheet opposite that which supports the pattern 15. This eliminates the need to laminate two separately printed articles to one another.

The invention provides an image display 10, 30 including a base 12 having a front surface 12*a*, an adhesive pattern 15 formed over a first area of front surface 12*a*, a reflective layer 18 formed over the adhesive pattern 15, and an image 20 formed over a second area of the front surface 12*a* which is at least partially not occupied by the reflective layer 18. Reflective layer 18 is preferably a reflective foil layer transferred from a roll leaf. Adhesive pattern 15 is preferably heat activated adhesive. The reflective foil layer is transferred only to pattern 15 over the noted first area where heat activated adhesive is applied. In one form, adhesive pattern 15 is a textured pattern, and the adhesive pattern and the textured pattern are the same, i.e. a single layer textured adhesive coating of varying thickness. The textured adhesive pattern of varying thickness has a plurality of thicker portions providing protrusions 15*a*, and a plurality of thinner portions providing recesses 15*b*, wherein the reflective layer 18 is formed over protrusions 15*a* and over recesses 15*b*. In a further embodiment, FIG. 2, the noted first and second areas overlap in the noted third area, and adhesive pattern 15 and reflective layer 18 are formed over image 20*b*' in such third area.

The invention provides a method for making an image display 10, 30 by providing a base 12 having a front surface 12*a*, forming an adhesive pattern 15 over a first area of the front surface 12*a*, forming a reflective layer 18 over the adhesive pattern 15, and forming an image 20 over a second area of the front surface 12*a* which is at least partially not common with the noted first area. Adhesive pattern 15 is preferably formed of heat activated adhesive, and reflective layer 18 is preferably formed by transferring a reflective foil layer from a roll leaf by heat and pressure. The reflective foil layer is transferred to pattern 15 only over the noted first area at the noted heat activated adhesive pattern. The embodiment of FIG. 2 involves overlapping the noted first and second areas at the noted third area, forming the image 20*b*' over the second area prior to forming adhesive pattern 15 and reflective layer 18, and then forming adhesive pattern 15 and reflective layer 18 over the image 20*b*' in the noted third area.

In one form of the method of the present invention, the method involves applying as a single coating layer a textured heat activated adhesive pattern 15 of varying thickness on a first area of front surface 12*a* of base 12, eliminating a textured pattern layer separate from an adhesive layer.

Figure 9:
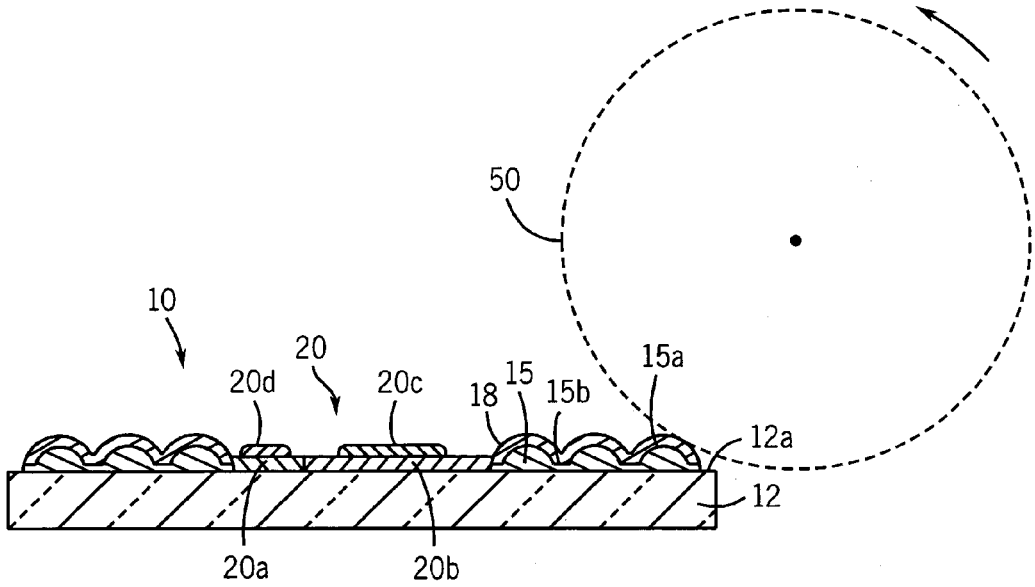
FIG. 9 is like FIG. 1 and illustrates a manufacturing step.

In a preferred manufacturing step, the noted reflective foil layer is transferred by using a heated resiliently conformable roller 50, FIG. 9, preferably a rubber roller. The heated resiliently conformable roller resiliently compresses at protrusions 15*a* and resiliently conforms to recesses 15*b*.

The invention provides a method for improving economy of manufacture of the image display by combining the texture pattern layer and the adhesive layer as a single coating formed with varying thickness in a pattern of a plurality of thicker portions providing protrusions 15*a* and a plurality of thinner portions providing recesses 15*b*.

In various embodiments, image 20 may optionally be deleted, whereby there is no image, or the image is provided by the reflective foil layer 18 and its pattern.

It is recognized that various equivalents, alternatives and modifications are possible within the scope of the appended claims.

What is claimed is:

1. A display comprising:

a base having a front surface;

an adhesive pattern formed over a first area of said front surface;

a reflective layer over said adhesive pattern;

an image formed over a second area of said front surface which is at least partially not occupied by said reflective layer;

wherein said first area and said second area overlap in a third area.

2. The display according to claim 1 wherein said adhesive pattern and said reflective layer are formed over said image in said third area.

3. The display according to claim 1 wherein said image overlaps said pattern and said reflective layer in said third area.

4. The display according to claim 2 wherein said third area is substantially co-extensive with said first area.

5. A display comprising:

a base having a front surface;

an adhesive pattern formed over a first area of said front surface;

a reflective layer over said adhesive pattern;

an image formed over a second area of said front surface which is at least partially not occupied by said reflective layer;

an additional image formed over at least a portion of said reflective layer;

wherein said additional image comprises an at least partially transparent area.

6. A display comprising:

a base having a front surface;

an adhesive pattern formed over a first area of said front surface;

a reflective layer over said adhesive pattern;

an image formed over a second area of said front surface which is at least partially not occupied by said reflective layer;

an additional image formed over at least a portion of said reflective layer;

wherein said additional image comprises opaque and at least partially transparent areas.

7. A display comprising:

a base having a front surface;

an adhesive pattern formed over an area of said front surface; and a reflective layer over said adhesive pattern, wherein said base is at least partially transparent and has a rear surface opposite to said front surface, and comprising an additional reflective layer formed over said rear surface.

8. A display comprising:

a base having a front surface;

an adhesive pattern formed over a first area of said front surface;

a reflective layer over said adhesive pattern;

an image formed over a second area of said front surface which is at least partially not occupied by said reflective layer, wherein said base is at least partially transparent and has a rear surface opposite to said front surface, and said image display further comprises an additional reflective layer formed over said rear surface.

9. A display comprising:

a base having a front surface;

a textured adhesive pattern of heat activated adhesive formed over a first area of said front surface and having varying thickness comprising a plurality of thicker portions providing protrusions;

a reflective layer comprising a reflective foil layer transferred from a roll leaf only to said pattern over said first area where said heat activated adhesive is applied, said reflective foil layer being formed over said protrusions; and an image formed over a second area of said front surface which is at least partially not occupied by said reflective foil layer.

* * * * *